US009291037B2

(12) United States Patent
Pasvandi

(10) Patent No.: US 9,291,037 B2
(45) Date of Patent: Mar. 22, 2016

(54) CUTTING UNIT OF A SLOT PERFORATOR (VARIANTS)

(75) Inventor: Marie Pasvandi, Limassol (CY)

(73) Assignee: Passerby Inc., Providence, Mahe (SC)

( * ) Notice: Subject to any disclaimer, the term of this patent is extended or adjusted under 35 U.S.C. 154(b) by 290 days.

(21) Appl. No.: 13/984,612

(22) PCT Filed: Feb. 8, 2012

(86) PCT No.: PCT/IB2012/000215

§ 371 (c)(1),
(2), (4) Date: Aug. 9, 2013

(87) PCT Pub. No.: WO2012/107824

PCT Pub. Date: Aug. 16, 2012

(65) Prior Publication Data

US 2014/0083674 A1 Mar. 27, 2014

(30) Foreign Application Priority Data

Feb. 10, 2011 (RU) ..... 2011106440

(51) Int. Cl.
*E21B 43/112* (2006.01)

(52) U.S. Cl.
CPC ..... *E21B 43/112* (2013.01)

(58) Field of Classification Search
USPC ..... 166/297, 298, 55, 55.2; 405/184.2, 184; 138/97
See application file for complete search history.

(56) References Cited

U.S. PATENT DOCUMENTS 8,899,313 B2 * 12/2014 Pasvandi ..... 166/55.3
2013/0319651 A1 * 12/2013 Pasvandi ..... 166/55.2

* cited by examiner

*Primary Examiner* — William P Neuder
*Assistant Examiner* — Ronald Runyan
(74) *Attorney, Agent, or Firm* — Aleksandr Smushkovich

(57) ABSTRACT

A cutting unit for a slot-type perforator is mounted in a casing, driven by a pusher, containing cutting tools with an extension mechanism for extending thereof, including a holder fixed to the pusher and another holder fixed to the casing. The holders are capable of rotating, causing an extension and retraction of the cutting tools from and to the casing. The extension mechanism includes a balance beam, having shoulders for placing the cutting tools and being assembled in the casing between the holders. The beam rotates around an axle during interaction with the holders. The axle is adapted to move along the longitudinal axis of the casing, e.g. in a groove arranged therein. The cutting unit may include at least two balance beams sequentially mounted between the holders. The cutting unit can be equipped with a retractable mechanism bringing parts thereof into a transportation position and fixing them therein.

9 Claims, 1 Drawing Sheet

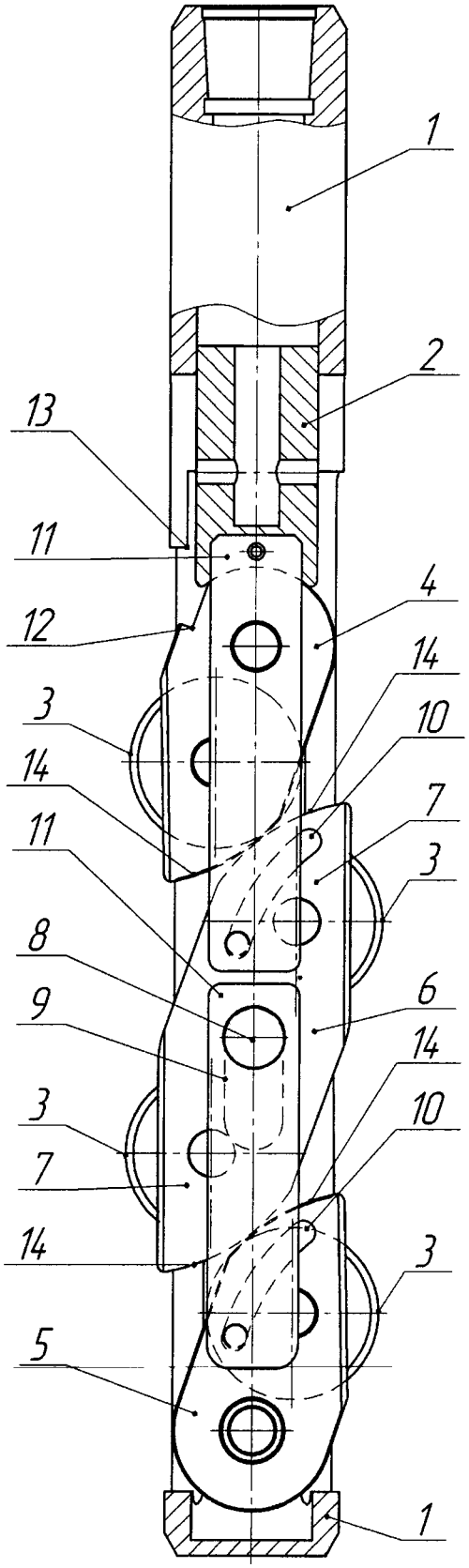
1
2
13
11
12
4
14
3
10
14
7
11
3
8
6
9
14
3
10
7
14
3
5
1

CUTTING UNIT OF A SLOT PERFORATOR (VARIANTS)

CROSS-REFERENCE TO RELATED APPLICATIONS

This application is a U.S. national stage application of a PCT application PCT/IB2012/000215 filed on 8 Feb. 2012, published as WO2012107824, whose disclosure is incorporated herein in its entirety by reference, which PCT application claims priority of a Russian Federation patent application RU2011106440 filed on 10 Feb. 2011.

FIELD OF THE INVENTION

The proposed invention relates to drilling and well operations, in particular to the design of devices for the opening of productive layers through a slot perforation, and may be used in the construction and repair of wells for various purposes.

BACKGROUND OF THE INVENTION

In the prior art are known the cutting units of hydro-mechanical slot perforating machines, which include cutting tools enabling to form simultaneously two perforation slots in the production string, with the mechanism of their extension, for example, disclosed in patents RU 2249678 C2, IPC E21B 43/112, 10.04.2005, RU 2302515 C2, IPC E21B 43/112, 10.07.2007, RU 2348797 C1, IPC E21B 43/112, 10.03.2009. These analogs include cutting tools in the form of two cutting discs mounted on the axis in the balance beam shoulders, or in the form of two cutters, or in the form of two cutting edges of the rotary knife. Thus, the analogs use only two cutting tools, diametrically oriented, each of which performs a perforation slot from its side. The speed of slots formation in each projection is relatively low.

It is obvious that the speed of perforation slot formation in the column may be increased if not one but multiple cutting tools will be simultaneously involved in the process of its formation. The productivity of the cutting unit will increase in the number of times depending on the quantity of cutting tools which will be involved in the work.

There are multi-sectional cutting units of slot-type perforating machines involving several sections or working cylinders containing one or two cutting tools: RU 2371569 C1, IPC 21B 43/112, 27.10.2009, RU 86654 U1, IPC E21B 43/112, 10.09.2009, RU 2389867 C1, IPC E21B 43/112, 20.05.2010. Such devices, in the case if orientation of the cutting tools of several sections (working cylinders) is in one projection, may be used to accelerate the formation of perforating slots.

However, the disadvantage of multiple-cutting units is the application of cutting tools extension mechanisms, suggesting the presence of a significant distance between the cutting tools in working position.

For example, if the cutting tools of different sections have orientation so that some of them are located in one projection, and some—are located in another, we get a double-sided cutting unit with several working tools on each side. However, the large distance between the cutting tools will lead to the fact that they will work on segments of the perforation interval, only partially overlapping, so the segments of perforating slots formed at the same time will have a significant height difference. This will lead to uneven opening of the column and to uneven wear of cutting tools, as well as to the possibility of unwanted disclosure of the column outside of the perforation interval.

In addition, the utilization of the known extension mechanisms of cutting tools in multi-sectional cutter units, especially those where the section contains only one cutting tool, results in increase of perforators size, making them too long, cumbersome, affects the performance of the perforators.

The above drawbacks complicate the use of perforators with multi-sectional cutting units for the purpose of acceleration of perforating slots formation.

The objective of the proposed invention is to create a design of slot-type perforator cutting unit, which is more compact in size and provides more uniform opening of the production column with the simultaneous acceleration of the formation of at least two perforation slots of sufficient depth.

The closest cutting unit to the invention is herein referred to as a 'prototype', which is a hydro mechanical slot-type perforator cutting unit as per a Russian Federation Patent for Utility Model RU 100802 U1, IPC E21B 43/112, 27.12.2010.

The cutting unit of a hydro mechanical slot-type perforator of the prototype includes telescoping blades mounted on the axes of the upper and lower holders, which are set inside the perforator's case by means of the fingers, while the upper holder is mounted on the plunger and the lower holder is secured to the casing, in addition, holders are made flat and located in the same plane with the possibility of deviations in opposite directions during translational impact of the plunger, in addition, working surfaces of the holders interacting with each other are mounted at the ends of the holders, rounded, and the lower holder is additionally provided with a supporting surface with the possibility of exposure to the lower spring anchor through the washer, while the lower spring is located in the glass—the tensioner. The diameter of the cutting disks used in the construction of the cutting unit in the prototype is close to the diameter of the perforator's casing that allows creating perforations slots of a considerable depth.

The disadvantage of the cutting unit according to the prototype is the possibility of the inclusion of only two cutting disks—one disk for each of two projections of the perforation slots forming that does not accelerate opening of the column. This is due to the construction of the extension mechanism of cutting tools, consisting of two coupled holders.

The lack of a mechanism to bring the cutting unit in the transport position and fix it in this position before and after perforation can also be attributed to the disadvantages of the prototype.

SUMMARY OF THE INVENTION

The proposed invention eliminates the disadvantages of the prototype, and achieves the following technical result:

1. Increased productivity of cutting unit, increase in the speed of formation of perforating slots.
2. Improving the performance of the perforator through quite compact embodiment of cutting unit with improved performance.
3. Providing a uniform quality and sufficient depth of perforating slots formation.
4. Improving the reliability of perforator, except wedging of cutting tools in the column.
5. Extended use of cutting tools due to decrease of wear.

The mentioned technical result is achieved by providing the inventive design of the cutting unit in terms of location, quantity, and a novel structure for an extension mechanism of the cutting tools.

A first embodiment included in the proposed invention is a cutting unit for a slot-type perforator; the cutting unit is mounted in a casing having a longitudinal axis and a specific edge; the cutting unit is driven by a pusher, for example, a piston or plunger, which includes telescopic cutting tools with an extension mechanism in the form of holders, one of which is fixed relative to the pusher and the other is fixed with respect to the casing, and the holders are made rotatable with the ability of cutting tools extension from the perforator's casing. According to the invention, the extension mechanism of the cutting tool further comprises a balance beam having shoulders, in which shoulders at least some of the cutting tools are located; wherein the balance beam is mounted in the casing, between the holders, with the ability of rotation around an axle in contact with the holders, and the axle of the balance beam is made to be movable relative to the longitudinal axis of the casing, for example, in a groove made in the casing.

The cutting unit of the first embodiment may be additionally provided with a retractable mechanism for bringing telescoping parts thereof into a transportation position and fixing them in this position; for example, the cutting unit may include guide grooves made in the balance beam and in the holder, fixed relative to the casing, and connecting rods are respectively attached to the holder fixed with respect to the pusher, or to the pusher itself, and to the balance beam; the connecting rods are made with the ability to move through the respective grooves and thereby ensuring the return of the balance beam and the holder with the groove into the transportation position during the reverse movement of the pusher; the cutting unit comprises a recess made in the holder fixed with respect to the pusher; the recess has a shape similar to (or capable of cooperating with) the specific edge of the casing, with the possibility of fixation of the holder in the case in the absence of force applied to the plunger during an engagement of the casing's edge with the groove of the holder.

The second embodiment included in the proposed invention is a cutting unit for a slot-type perforator; the cutting unit is mounted in a casing having a longitudinal axis and a specific edge; the cutting unit is associated with and driven by a pusher, for example, a piston or plunger; the cutting unit includes telescopic cutting tools with an extension mechanism in the form of holders, one of which is fixed relative to the pusher, and the other holder is fixed with respect to the casing; and the holders are made rotatable with the ability of the cutting tools to extend form and retract to the casing. According to the invention, the extension mechanism of the cutting tool further comprises at least two balance beams; each balance beam rotates about an axle, and includes two shoulders; the cutting tools are mounted in at least one such shoulder; wherein the balance beams are sequentially mounted in the casing between the holders with the ability to interact with the holders and with each other, and with the possibility of rotation during a serial transmission of pusher's force through the holder fixed relative to the pusher and oppositely directed resistance force of the holder fixed relative to the casing; wherein the axles are located along one line as to be movable relative to the longitudinal axis of the casing, such as along a groove made in the casing.

The cutting assembly of the second embodiment, similar to the first embodiment, may be additionally provided with a retractable mechanism for bringing telescoping parts thereof in a transportation position and fixing them in this position; the retractable mechanism, for example, includes guide grooves made in the balance beams and in the holder, fixed relative to the casing, and at least two connecting rods, sequentially attached to the holder fixed with respect to the pusher, or immediately attached to the pusher, and, on the other hand, to the balance beams, made with the ability to move through the respective grooves and thereby ensuring the return of the balance beams and the holder with the groove into the transportation position during the reverse movement of the pusher; the retractable mechanism further includes a recess made in the holder fixed with respect to a pusher, wherein the recess has a shape similar to (or capable of cooperating with) the shape of the edge of the casing, with the possibility of fixation of the holder in the case in the absence of force applied to the plunger during an engagement of the casing's edge with the groove of the holder.

The cutting units can be equipped by extension mechanisms for extending the cutting tools in the form of a moving system of interacting parts (holders and balance beams) that enables incorporating additional cutting tools into the perforator, increasing productivity of the perforator in two or more times. In addition to increasing the speed of opening the column, the presence of two or more cutting tools, working in one projection, increases the reliability of the perforator, helping to avoid jamming of the device in the case of ingress of one of the cutting tools in areas of the column, previously damaged by cumulative perforation.

The cutting units of the present invention are substantially smaller than similar known multi-sectional devices; they produce perforation slots more evenly, as the inventive cutting tools in the working position are located close enough to each other. It is important that the size of the cutting tool is close to the diameter of the perforator's casing, resulting in a sufficient depth of the cut of perforating slots.

The presence of the retractable mechanism in the inventive cutting units enables bringing their parts into the transportation position and fixing them in the position that provides for secure locking of the cutting tools in the perforator's casing in the transportation position, which prevents their spontaneous extension and improves operation safety of the perforator.

Cutting units of both the above-described embodiments of the proposed invention can have the following features.

The holders and the balance beams bearing the cutting tools may have the form of a wedge-type shackle and wedge-type balance beams performed with the possibility of turning during the interaction of the wedge surfaces. This form allows for ultimately setting the direction for their movement during the interaction, which is necessary in the beginning stage of the process of their extension from the perforator's casing.

Surfaces of the wedge-type shackles and wedge-type balance beams may have a rounded shape. As a result of the kinematic analysis, it was determined that this form allows for keeping an almost constant value of the force aimed at the extension of the holders and the balance beams from the perforator's casing at any stage of the extension process. In addition, the rounded shape of the wedge-type surfaces allows the wedge-type shackles and wedge-type balance beams to return gradually to their original position with a decrease in the intensity of their interaction, while preventing their jamming in the operating (extended) position.

Various types of the cutting tools can be used in the proposed cutting units. The cutting tools can be mounted on the holders and balance beams in the form of discs (mills) mounted on the axles, either in the form of cutters, or in the form of knives. In addition, the cutting tools can be mounted directly on the holders and the balance beams, for example, in the form of their edges, treated in a certain way to provide cutting properties therefor, for example, sharpened, or fitted with hard alloy inserts.

BRIEF DESCRIPTION OF DRAWING OF THE INVENTION

One of preferred embodiments of the invention is shown in the drawing attached hereto.

DETAIL DESCRIPTION OF PREFERRED EMBODIMENTS OF THE INVENTION

While the invention may be susceptible to embodiment in different forms, there are shown in the drawing, and will be described in detail herein, specific embodiments of the present invention, with the understanding that the present disclosure is to be considered an exemplification of the principles of the invention, and is not intended to limit the invention to that as illustrated and described herein.

Referring to the drawing, the inventive cutting unit is incorporated into a slot-type perforator comprising: a casing 1 having a specific edge 13, and a piston 2 movable within the casing 1; the cutting unit is mounted in the casing 1, and is associated with and driven by the piston 2; the cutting unit includes telescoping cutting tools 3 with a mechanism of their extension accomplished in the form of holders 4, 5, one of which 4 is fixed with the respect to the piston 2 and the other 5 is fixed with the respect to the casing 1. The holders 4 and 5 are executed with the ability of rotation with the extension of the cutting tools 3 from the casing 1. The mechanism of extension of the cutting tools 3 additionally includes a balance beam 6 with shoulders 7, while at least some of the cutting tools 3 are placed in the shoulders 7; the balance beam 6 is mounted in the casing 1 between the holders 4 and 5 with the ability of rotation during interaction with them, and an axle 8 of rotation of the balance beam 6 is adapted to move relative to the longitudinal axis of the casing 1 in a groove 9, executed in the casing 1.

The cutting unit is equipped with a retractable mechanism to bring movable parts thereof into a transportation position and to fix them in this position; the retractable mechanism includes guide grooves 10 made in the balance beam 6 and in the holder 5, fixed relative to the casing 1, and connecting rods 11, respectively attached to the piston 2 and to the balance beam 6, executed with the possibility of moving along the respective grooves 10 and thereby ensuring the return of the balance beam 6 and the holder 5 with the groove 10 into the transportation position at the reverse movement of the piston 2; the retractable mechanism further includes a recess 12, executed in the holder 4 fixed relative to the piston 2, in the form close to the edge 13 of the casing 1, with the possibility of fixation of the holder 4 in the casing 1 in the absence of force applied to the piston 2, which force is produced by an engagement of the casing's edge 13 with the recess 12 of the holder 4.

In the embodiment of the invention presented in the drawing, the holders 4 and 5 are represented by wedge-type shackles, and the balance beam 6 is a wedge-shaped beam, which wedge-type shackles and wedge-shaped beam have wedge-shaped surfaces 14 correspondingly mating with each other. The wedge-type shackles 4, 5, and the wedge-shaped balance beam 6 are rotatable at the interaction of their wedge surfaces 14, whose tips preferably have a rounded shape. The cutting tools 3 are mounted on the holders 4, 5 and on the balance beam 6 in the form of disks mounted on axles.

OPERATION AND APPLICABILITY OF THE INVENTION

The inventive device operates as follows. A force is applied to the piston 2, under the action of which the piston 2 is moved progressively along the axis of the perforator, activating the mechanisms of the cutting unit. The holder 4 fixed with respect to the piston 2 moves to the balance beam 6. Their wedge-type surfaces 14 interact and move relative to each other.

At the same time, the rotation of the holder 4 and the balance beam 6 is performed, causing an extension of the cutting tools 3, located on the holder 4 and in the shoulders of the balance beam 6, from the perforator's casing. While turning, the balance beam 6 moves along the axis of the casing 1, along the groove 9 to the holder 5 fixed relative to the casing 1. The wedge-type surfaces 14 of the beam 6 and the holder 5 interact, resulting in a rotation of the holder 5, which pushes the cutting tool 3, located on the holder 5, from the casing. Thus, all the cutters 3 are telescopically extending towards two opposite directions, i.e. two cutting tools move in each direction, and take up the working position. Slot perforation is performed in a known manner.

After the completion of the perforating slots formation process, other downhole operations (cavities aggradation, hydrodynamic treatment of formation, acid treatment, etc.) can be accomplished through the perforator, if it is necessary and provided by the design of the perforator. After that, the force applied onto the piston 2 is reduced, and it makes a reverse movement regaining its original position. Following the movement of the piston 2, the connecting rod 11, attached to the piston, starts reverse movement along the groove 10 of the balance beam 6, turning the balance beam 6 and bringing it into its initial position together with the cutting tools 3 placed in its shoulders 7. At rotation of the beam 6, the connecting rod 11, attached to the beam, starts reverse movement along the groove 10 the holder 5, fixed relative to the perforator's casing 1, and, in its turn, brings the holder 5 together with its cutting tool 3 into the initial (transportation) position.

Thus, the balance beam 6 and the holder 5 with their cutting tools 3 are brought into the transportation position and held in this position by means of the connecting rods 11. At the same time, following the movement of the piston 2, the holder 4, fixed with respect to it, is also moved into its initial position. When it reaches the edge 13 of the perforator's casing 1, the recess 12 of the holder 4 coincides with the edge 13 of the perforator's casing 1 and interlocking takes place, i.e. the edge 13 and the recess 12 get engaged. Thus, the holder 4, after taking up the transportation position, is fixed in the casing.

Brought into the transportation position, the perforator can be extracted from the well or moved to a new perforation interval to continue working.

The invention claimed is:

1. A cutting unit for a hydro-mechanical slot-type perforator having a longitudinal axis, said cutting unit is mounted in a casing; said cutting unit is associated with and driven by a pusher capable of moving in the casing; said cutting unit comprises:

a number of cutting tools;

a first holder immovable relative to the pusher;

a second holder immovable relative to the casing; the first holder and the second holder are capable of rotation;

a balance beam rotatable around an axle; said balance beam is assembled in the casing between the first holder and the second holder; said balance beam is capable of pairwise interaction with the first holder and the second holder causing a rotation of said balance beam, with an extension and a retraction of said cutting tools from and into the casing respectively; said balance beam includes shoulders, containing at least some of said cutting tools;

wherein said axle is adapted to move along the longitudinal axis, and wherein said casing having an edge with a specific edge shape; said cutting unit further comprising:

a retractable mechanism for bringing said cutting unit into a transportation position and fixing said cutting unit therein; said retractable mechanism includes:

at least one holder guide groove made in the second holder, at least one beam guide groove made in the balance beam, and at least two connecting rods pairwise attached to the first holder and the balance beam; and to the second holder and the balance beam;

wherein said connecting rods are capable of moving along the corresponding grooves, thereby ensuring a return of the balance beam and the second holder into the transportation position at a reverse movement of the pusher; and a recess made in the first holder; said recess has a shape similar to, or capable of cooperating with said specific edge shape, thereby providing for fixation of the first holder in the casing, absence of pressure applied to the pusher.

2. A cutting unit for a hydro-mechanical slot-type perforator having a longitudinal axis, said cutting unit is mounted in a casing; said cutting unit is associated with and driven by a pusher capable of moving in the casing; said cutting unit comprises:

a number of cutting tools;

a first holder immovable relative to the pusher;

a second holder immovable relative to the casing; the first holder and the second holder are capable of rotation;

a balance beam rotatable around an axle; said balance beam is assembled in the casing between the first holder and the second holder; said balance beam is capable of pairwise interaction with the first holder and the second holder causing a rotation of said balance beam, with an extension and a retraction of said cutting tools from and into the casing respectively; said balance beam includes shoulders, containing at least some of said cutting tools;

wherein said axle is adapted to move along the longitudinal axis, and wherein the first holder, the second holder, and the balance beam each is at least partially configured to include a wedge-type portion, and wherein the wedge-type portion of the first holder and the wedge-type portion of the balance beam, as well as the wedge-type portion of the second holder and the wedge-type portion of the balance beam are capable of pairwise interaction causing rotation thereof.

3. The cutting unit according to claim 2, wherein each said wedge-type portion has a tip with a rounded shape.

4. A cutting unit for a hydro-mechanical slot-type perforator having a longitudinal axis, said cutting unit is mounted in a casing; said cutting unit is associated with and driven by a pusher capable of moving in the casing; said cutting unit comprises:

a number of cutting tools;

a first holder immovable relative to the pusher;

a second holder immovable relative to the casing; the first holder and the second holder are capable of rotation;

a balance beam rotatable around an axle; said balance beam is assembled in the casing between the first holder and the second holder; said balance beam is capable of pairwise interaction with the first holder and the second holder causing a rotation of said balance beam, with an extension and a retraction of said cutting tools from and into the casing respectively; said balance beam includes shoulders, containing at least some of said cutting tools;

wherein said axle is adapted to move along the longitudinal axis, and wherein the cutting tools are represented by discs or mills installed on axles; or by cutters; or by knives; said cutting tools are mounted directly on the first holder, the second holder, and the balance beam; or wherein the first holder, the second holder, and the balance beam are provided with edges possessing cutting properties, and the cutting tools are represented by said edges.

5. A cutting unit for a hydro-mechanical slot-type perforator having a longitudinal axis, said cutting unit is mounted in a casing; said cutting unit is associated with and driven by a pusher capable of moving in the casing; said cutting unit comprises:

a number of extendable cutting tools;

a first holder immovable relative to the pusher;

a second holder immovable relative to the casing; the first holder and the second holder are capable of rotation;

at least two balance beams each rotatable around an axle; said balance beams are sequentially mounted in the casing between the first holder and the second holder; said balance beams are capable of pairwise interaction with each other, with the first holder, and the second holder, causing rotation of said balance beams, during sequential applying a force from the pusher via the first holder and an opposite reaction force from the casing via the second holder; wherein said balance beams each includes two shoulders, at least one of the shoulders contains at least some of said cutting tools;

and wherein all the axles of the balance beams are located along one line, and capable of moving along the longitudinal axis.

6. The cutting unit according to claim 5, wherein said casing having an edge with a specific edge shape; said cutting unit further comprising:

a retractable mechanism for bringing said cutting unit into a transportation position and fixing said cutting unit therein; said retractable mechanism includes:

at least one holder guide groove made in the second holder, at least one beam guide groove made in the balance beams, and at least two connecting rods sequentially attached either to the first holder, or to the pusher, and to the respective balance beams;

wherein said connecting rods are capable of moving along the corresponding grooves, thereby ensuring a return of the balance beams and the second holder into the transportation position at a reverse movement of the pusher;

a recess made in the first holder; said recess has a shape similar to, or capable of cooperating with said specific edge shape, thereby providing for fixation of the first holder in the casing, absence of pressure applied to the pusher.

7. The cutting unit according to claim 5, wherein the first holder, the second holder, and the balance beams each is at least partially configured to include a wedge-type portion, and wherein the wedge-type portion of the first holder and the wedge-type portion of the corresponding balance beam, as well as the wedge-type portion of the second holder and the wedge-type portion of the corresponding balance beam are capable of pairwise interaction causing rotation thereof.

8. The cutting unit according to claim 7, wherein each said wedge-type portion has a tip with a rounded shape.

9. The cutting unit according to claim 5, wherein the cutting tools are represented by discs or mills installed on axles; or by cutters; or by knives; said cutting tools are mounted directly on the first holder, the second holder, and the balance beams; or wherein the first holder, the second holder, and the balance beams are provided with edges possessing cutting properties, and the cutting tools are represented by said edges.

* * * * *